US007090592B2

(12) United States Patent
Watanabe et al.

(10) Patent No.: US 7,090,592 B2
(45) Date of Patent: Aug. 15, 2006

(54) MULTI-PIECE SOLID GOLF BALL

(75) Inventors: Hideo Watanabe, Chichibu (JP); Hiroyuki Nagasawa, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/837,742

(22) Filed: May 4, 2004

(65) Prior Publication Data

US 2005/0250599 A1 Nov. 10, 2005

(51) Int. Cl.
*A63B 37/06* (2006.01)

(52) U.S. Cl. ..... 473/373

(58) Field of Classification Search ..... 473/373, 473/374

See application file for complete search history.

(56) References Cited

U.S. PATENT DOCUMENTS 6,183,382 B1 * 2/2001 Kim et al. ..... 473/374
6,592,470 B1 7/2003 Watanabe et al.
6,663,507 B1 12/2003 Watanabe et al.
6,861,474 B1 * 3/2005 Kim ..... 525/71
2002/0177492 A1 * 11/2002 Watanabe et al. ..... 473/371
2003/0073516 A1 * 4/2003 Watanabe et al. ..... 473/378
2003/0158340 A1 * 8/2003 Iwami ..... 525/184
2004/0029651 A1 * 2/2004 Jordan et al. ..... 473/376
2004/0116211 A1 * 6/2004 Sullivan et al. ..... 473/374

FOREIGN PATENT DOCUMENTS

JP 06-343718 A 12/1994
JP 11-035633 A 2/1999
JP 11-164912 A 6/1999
JP 2002-293996 A 10/2002
JP 2003-175128 A 6/2003

* cited by examiner

*Primary Examiner*—Raeann Gorden
(74) *Attorney, Agent, or Firm*—Sughrue Mion, PLLC

(57) ABSTRACT

The invention provides a multi-piece solid golf ball comprising a core, an outermost layer cover, and at least one intermediate layer disposed therebetween, characterized in that the intermediate layer is formed of a resin composition having organic short fibers compounded therein. The golf ball has excellent flight performance and controllability in favor of professional and skilled golfers having high head speeds, and is improved in durability to repeated impact.

15 Claims, 1 Drawing Sheet

MULTI-PIECE SOLID GOLF BALL

BACKGROUND OF THE INVENTION

This invention relates to multi-piece solid golf balls having excellent flight performance in the high head speed (HS) region intended for professional and skilled golfers, excellent controllability on iron shots and approach shots, and improved durability to repeated impact.

At present, of golf balls having a good balance of superior distance performance in the high head speed region intended for professional and skilled golfers and controllability on iron shots and approach shots, three-piece solid golf balls having a cover inner layer which is hard and a cover outer layer which is made of urethane resin are on widespread use.

Such golf balls are found in U.S. Pat. No. 6,663,507 describing a three-piece solid golf ball in which the intermediate layer and the cover are formed of urethane resins, and the intermediate layer is relatively hard, and U.S. Pat. No. 6,592,470 describing a three-piece solid golf ball in which the cover is made of urethane and the intermediate layer is relatively thick. Other golf balls include the one described in JP-A 6-343718.

In these golf balls, however, the cover is insufficiently improved in durability to repeated impact, with a particular tendency of allowing the intermediate layer to crack.

Also, JP-A 2003-175128 describes a golf ball whose cover has a ternary composite of rubber/polyolefin/nylon components compounded therein. This description does not relate to a golf ball of three-layer structure or make investigation on durability to repeated impact.

SUMMARY OF THE INVENTION

The present invention has been devised in consideration of the above-discussed circumstances and its object is to provide a golf ball intended for play by professional and skilled golfers with high head speed capability, having excellent flight performance, excellent controllability, and improved durability to repeated impact.

With regard to conventional popular three-piece solid golf balls in which the intermediate layer is hard and the outermost layer cover is made of urethane resin, the inventors learned that cracks start from the intermediate layer when the ball is repeatedly hit in the high head speed region. Then with a focus on the improvement of the intermediate layer, the inventors made efforts on golf ball development. As a result, the inventors have found that the above object is achievable by a multi-piece solid golf ball comprising a core, an outermost layer cover, and at least one intermediate layer disposed therebetween, characterized in that the intermediate layer is formed of a resin composition having organic short fibers compounded therein. The present invention is predicated on this finding.

Accordingly, the present invention provides a multi-piece solid golf ball as defined below.

[1] A multi-piece solid golf ball comprising a core, an outermost layer cover, and an intermediate layer of one or more layers disposed therebetween, characterized in that at least one layer of the intermediate layer is formed of a resin composition having organic short fibers compounded therein.

[2] The multi-piece solid golf ball of claim 1, wherein a sphere in the form of the core enclosed with the intermediate layer has a surface hardness of 56 to 75 in Shore D hardness, the ball as a whole has a surface hardness of 52 to 64 in Shore D hardness, the surface hardness of the ball as a whole is lower than the surface hardness of said sphere, and the total gage of said intermediate layer and said outermost layer cover is in the range of 1.5 to 3.0 mm.

[3] The multi-piece solid golf ball of claim 1, wherein the organic short fibers compounded in said intermediate layer are made of a binary copolymer consisting of a polyolefin component and a polyamide component.

[4] The multi-piece solid golf ball of claim 1, wherein the resin composition of which the intermediate layer is formed includes a resin component comprising, in admixture, a base resin comprising, in admixture, (a) an olefin-unsaturated carboxylic acid binary random copolymer and/or a metal ion-neutralized product of an olefin-unsaturated carboxylic acid binary random copolymer and (b) an olefin-unsaturated carboxylic acid-unsaturated carboxylic acid ester ternary random copolymer and/or a metal ion-neutralized product of an olefin-unsaturated carboxylic acid-unsaturated carboxylic acid ester ternary random copolymer in a weight ratio between 100:0 and 25:75, and (e) a non-ionomeric thermoplastic elastomer in a weight ratio between 100:0 and 50:50.

[5] The multi-piece solid golf ball of claim 1, wherein the resin composition of which the intermediate layer is formed is a mixture comprising, in admixture, 100 parts by weight of a resin component comprising, in admixture, a base resin comprising, in admixture, (a) an olefin-unsaturated carboxylic acid binary random copolymer and/or a metal ion-neutralized product of an olefin-unsaturated carboxylic acid binary random copolymer and (b) an olefin-unsaturated carboxylic acid-unsaturated carboxylic acid ester ternary random copolymer and/or a metal ion-neutralized product of an olefin-unsaturated carboxylic acid-unsaturated carboxylic acid ester ternary random copolymer in a weight ratio between 100:0 and 25:75, and (e) a non-ionomeric thermoplastic elastomer in the form of a thermoplastic block copolymer containing crystalline polyethylene blocks as hard segments in a weight ratio between 100:0 and 50:50, (c) 5 to 80 parts by weight of a fatty acid having a molecular weight of 280 to 1,500 and/or derivative thereof, and (d) 0.1 to 10 parts by weight of a basic inorganic metal compound capable of neutralizing un-neutralized acid groups in said base resin and component (c).

[6] The multi-piece solid golf ball of claim 1, wherein the outermost layer cover is formed primarily of a polyurethane resin.

[7] The multi-piece solid golf ball of claim 1, wherein the outermost layer cover is formed of a material based on a heated mixture of (A) a thermoplastic polyurethane material and (B) an isocyanate mixture of (b-1) an isocyanate compound having at least two isocyanate groups as functional groups in a molecule, dispersed in (b-2) a thermoplastic resin which is substantially non-reactive with isocyanate.

It is to be noted that on account of the above-mentioned constructions, the golf ball of the invention has excellent flight performance in the high head speed (HS) region in favor of skilled golfers, excellent controllability on iron shots and approach shots, and improved durability to repeated impact. That is, the golf ball of the invention is improved in durability to repeated impact while maintaining good the basic properties that the ball exhibits when it is hit.

DETAILED DESCRIPTION OF THE INVENTION

Figure 1:
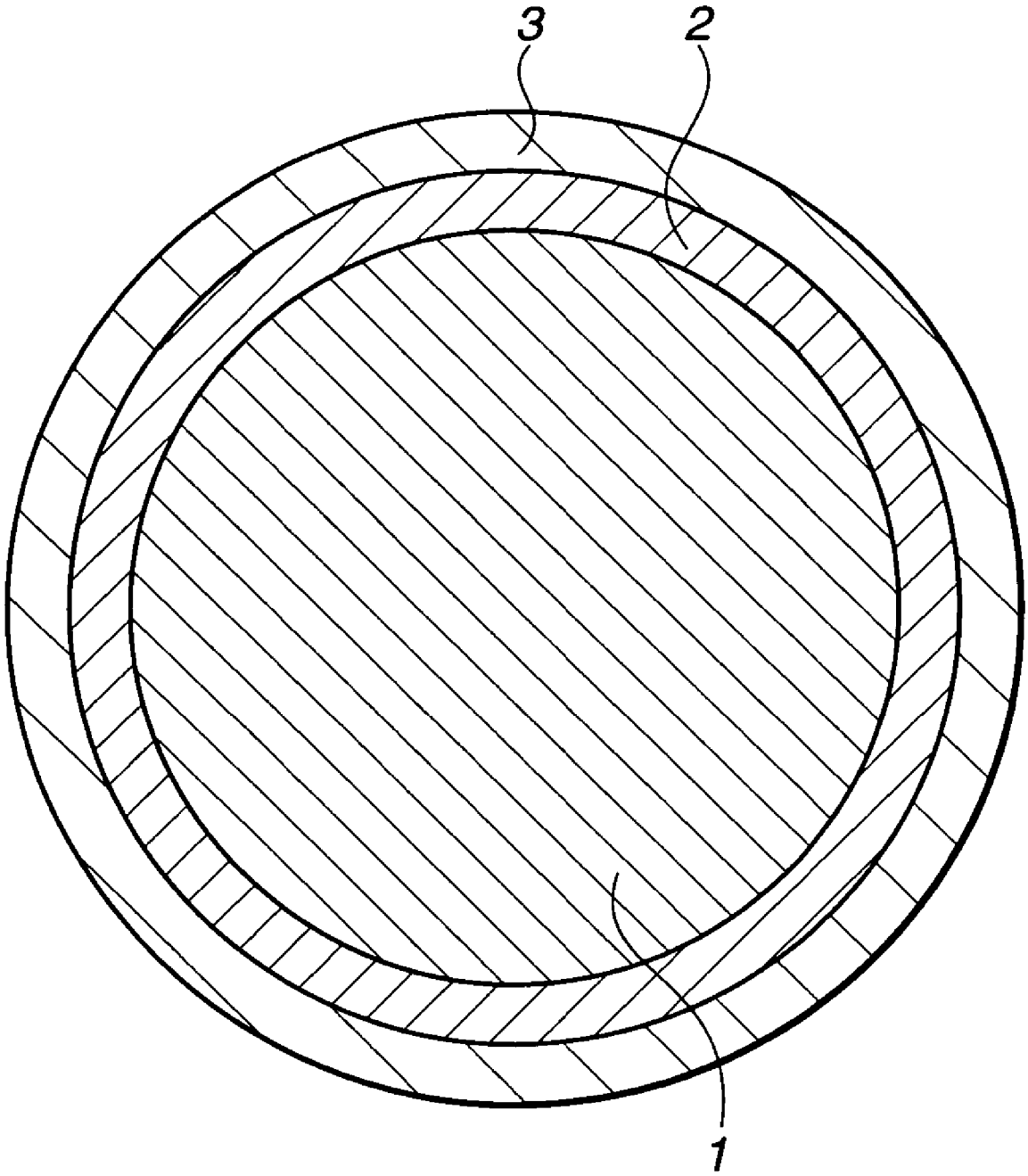
FIG. 1 is a schematic cross-sectional view of a golf ball in one embodiment of the invention.

The present invention is described in detail below.

The golf ball of the invention is a multi-piece solid golf ball of at least three-layer structure comprising a solid core, an outermost layer cover, and an intermediate layer disposed therebetween. For example, FIG. 1 illustrates a typical three-piece ball structure comprising a solid core 1, an outermost layer cover 3, and an intermediate layer 2 of a single layer or plural layers disposed therebetween.

The solid core may be formed, for example, of a rubber composition comprising a co-crosslinking agent, an organic peroxide, an inert filler, an organosulfur compound and the like. As the base rubber of this rubber composition, polybutadiene is preferably used.

The polybutadiene as the rubber component desirably has a cis-1,4 unit content on the polymer chain of at least 60 wt %, preferably at least 80 wt %, more preferably at least 90 wt %, and most preferably at least 95 wt %. Too low a cis-1,4 unit content in the molecule may lead to a lower resilience.

Moreover, the polybutadiene has a 1,2-vinyl unit content on the polymer chain of typically not more than 2%, preferably not more than 1.7%, and even more preferably not more than 1.5%. Too high a 1,2-vinyl unit content may lead to a lower resilience.

To obtain a molded and vulcanized rubber composition of good resilience, the polybutadiene used herein is preferably synthesized with a rare-earth catalyst or a Group VIII metal compound catalyst. Polybutadiene synthesized with a rare-earth catalyst is especially preferred.

Such rare-earth catalysts are not subject to any particular limitation. Exemplary rare-earth catalysts include those made up of a combination of a lanthanide series rare-earth compound with an organoaluminum compound, an alumoxane, a halogen-bearing compound and an optional Lewis base.

Examples of suitable lanthanide series rare-earth compounds include halides, carboxylates, alcoholates, thioalcoholates and amides of atomic number 57 to 71 metals.

The use of a neodymium catalyst in which a neodymium compound serves as the lanthanide series rare-earth compound is advantageous because it enables a polybutadiene rubber having a high cis-1,4 unit content and a low 1,2-vinyl unit content to be obtained at an excellent polymerization activity. Preferred examples of such rare-earth catalysts include those mentioned in JP-A 11-35633, JP-A 11-164912 and JP-A 2002-293996.

In the rubber component, the polybutadiene synthesized with a lanthanide series rare-earth compound catalyst is preferably contained in an amount of at least 10% by weight, preferably at least 20% by weight, more preferably at least 40% by weight for improving resilience.

Rubber components other than the above-described polybutadiene may be included in the base rubber, insofar as the objects of the invention are not impaired. Examples of such additional rubber components that may be used include polybutadienes other than the above-described polybutadiene, and other diene rubbers, such as styrene-butadiene rubbers, natural rubbers, isoprene rubbers and ethylene-propylene-diene rubbers.

Exemplary of the co-crosslinking agent are unsaturated carboxylic acids and metal salts of unsaturated carboxylic acids.

Examples of suitable unsaturated carboxylic acids include acrylic acid, methacrylic acid, maleic acid and fumaric acid. Acrylic acid and methacrylic acid are especially preferred.

Examples of suitable unsaturated carboxylic acid metal salts include, but are not limited to, the above unsaturated carboxylic acids which are neutralized with desired metal ions. Zinc, magnesium and other metal salts of methacrylic acid, acrylic acid and the like are illustrative, with zinc acrylate being especially preferred.

The amount of the unsaturated carboxylic acid and/or metal salt thereof is typically at least 10 parts, preferably at least 15 parts, more preferably at least 20 parts by weight, and as the upper limit, typically not more than 60 parts, preferably not more than 50 parts, more preferably not more than 45 parts, most preferably not more than 40 parts by weight, per 100 parts by weight of the base rubber. Too much amounts may make the core too hard, giving an unpleasant feel upon impact. Too little amounts may lead to a loss of resilience.

The organic peroxides may be commercially available products, such as Percumil D (by NOF Corporation), Perhexa 3M (by NOF Corporation) and Luperco 231XL (by Atochem Co.). They may be used alone or in admixture of any.

The amount of organic peroxide is typically at least 0.1 part, preferably at least 0.3 part, more preferably at least 0.5 part, and most preferably at least 0.7 part by weight, and as the upper limit, typically nor more than 5 parts, preferably not more than 4 parts, more preferably not more than 3 parts, and most preferably not more than 2 parts by weight, per 100 parts by weight of the base rubber. Too much or too little amounts may fail to achieve a satisfactory feel on impact, durability and resilience.

Examples of suitable inert fillers include zinc oxide, barium sulfate and calcium carbonate. Any one or combinations of two or more fillers may be used.

The amount of inert filler is typically at least 1 part, and preferably at least 5 parts by weight, and as the upper limit, not more than 50 parts, preferably not more than 40 parts, more preferably not more than 30 parts, and most preferably not more than 20 parts by weight, per 100 parts by weight of the base rubber. Too much or too little inert filler may fail to achieve an appropriate weight and good rebound characteristics.

If necessary, the rubber composition may include also an antioxidant, suitable examples of which include such commercial products as Nocrac NS-6 and NS-30 (by Ouchi Shinko Chemical Industry Co., Ltd.), and Yoshinox 425 (by Yoshitomi Pharmaceutical Industries, Ltd.). Any one or combinations of two or more thereof may be used.

The amount of antioxidant is typically at least 0 part, preferably at least 0.05 part, more preferably at least 0.1 part, and most preferably at least 0.2 part by weight, and as the upper limit, not more than 3 parts, preferably not more than 2 parts, more preferably not more than 1 part, and most preferably not more than 0.5 part by weight, per 100 parts by weight of the base rubber. Too much or too little antioxidant may fail to achieve good rebound characteristics and durability.

It is preferable for the core of the golf ball to include an organosulfur compound so as to enhance the rebound characteristics and increase the initial velocity of the ball.

The organosulfur compound is not subject to any particular limitation, provided it is able to enhance the rebound characteristics of the ball. Exemplary organosulfur compounds include thiophenols, thionaphthols, halogenated thiophenols, and metal salts thereof. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol, and organosulfur compounds having 2 to 4 sulfurs, such as diphenylpolysulfides, dibenzylpolysulfides, dibenzoylpolysulfides, dibenzothiazoylpolysulfides and dithiobenzoylpolysulfides. Diphenyldisulfide and the zinc salt of pentachlorothiophenol are especially preferred.

It is recommended that the organosulfur compound be included in an amount of typically at least 0.05 part, preferably at least 0.1 part by weight, and as the upper limit, typically not more than 5 parts, preferably not more than 4 parts, more preferably not more than 3 parts, and most preferably not more than 2.5 parts by weight, per 100 parts by weight of the base rubber. Too much organosulfur compound may cause the effects of addition to reach a point at which no further improvement occurs, whereas too little addition may fail to fully achieve the desired effects.

The core typically has a diameter of at least 36.7 mm, and more preferably at least 37.0 mm, and as the upper limit, not more than 40.5 mm, and more preferably not more than 38.5 mm. The core typically has a weight of 30 to 36 g, and more preferably 31 to 34 g.

The core has a surface hardness of 50 to 62, preferably 52 to 60, and more preferably 54 to 58, in Shore D hardness. The core has a center hardness of 34 to 46, preferably 36 to 44, and more preferably 38 to 42, in Shore D hardness. As used herein, "Shore D hardness" refers to a measurement by a type D durometer according to ASTM D-2240. Too high such hardness may invite too hard a feel on impact, too much spin, and a skying trajectory, traveling a short distance. Too low such hardness may result in too soft a feel on impact and too poor rebound to travel a distance.

The value of core surface hardness minus core center hardness is in a range of 4 to 30 units, preferably 7 to 25 units, more preferably 10 to 20 units, in Shore D hardness. If the hardness difference is too much, the durability to repeated impact may become poor. If the hardness difference is too small, the spin rate when hit with a driver (W#1) may increase, failing to travel a satisfactory distance.

In the invention, the material of which the outermost layer cover is made may be any well-known thermoplastic resin, preferably (C) a cover molding composition primarily comprising components (A) and (B) shown below.

(A) a thermoplastic polyurethane material (B) an isocyanate mixture of (b-1) an isocyanate compound having at least two isocyanate groups as functional groups in a molecule, dispersed in (b-2) a thermoplastic resin which is substantially non-reactive with isocyanate Now components (A), (B) and (C) are described.

(A) Thermoplastic Polyurethane Material

The thermoplastic polyurethane materials used herein are constructed of polymeric polyols (or polymeric glycols) as the soft segments, chain extenders as the hard segments, and diisocyanates. Any polymeric polyol employed in the prior art relating to thermoplastic polyurethane materials may be used as the starting reactant without particular limitation. Examples include polyester polyols and polyether polyols. Of these, polyether polyols are preferred to polyester polyols for the preparation of thermoplastic polyurethanes having a high modulus of resilience and good low-temperature properties. Suitable examples of polyether polyols include polytetramethylene glycol and polypropylene glycol, with polytetramethylene glycol being preferred for modulus of resilience and low-temperature properties. These polymeric polyols preferably have an average molecular weight of 1,000 to 5,000, with an average molecular weight of 2,000 to 4,000 being especially preferred for the preparation of thermoplastic polyurethanes having a high modulus of resilience.

Any chain extender employed in the prior art relating to thermoplastic polyurethane materials may be used. Exemplary chain extenders include, but are not limited to, 1,4-butylene glycol, 1,2-ethylene glycol, 1,3-butanediol, 1,6-hexanediol and 2,2-dimethyl-1,3-propanediol. These chain extenders preferably have an average molecular weight of 20 to 15,000.

Any diisocyanate employed in the prior art relating to thermoplastic polyurethane materials may be used. Illustrative examples include, but are not limited to, aromatic diisocyanates such as 4,4'-diphenylmethane diisocyanate, 2,4-toluene diisocyanate and 2,6-toluene diisocyanate; and aliphatic diisocyanates such as hexamethylene diisocyanate. However, some isocyanate compounds can make it difficult to control the crosslinking reaction during injection molding. In the practice of the invention, the use of 4,4'-diphenylmethane diisocyanate as a typical aromatic diisocyanate is most preferred for consistent reactivity with the isocyanate mixture (B) to be described later.

Commercial products may be used as the above-described thermoplastic polyurethane material. Illustrative examples include Pandex T-8290, T-8295 and T-8260 (manufactured by DIC Bayer Polymer, Ltd.), and Resamine 2593 and 2597 (manufactured by Dainichi Seika Colour & Chemicals Mfg. Co., Ltd.).

(B) Isocyanate Mixture

The isocyanate mixture (B) is one prepared by dispersing (b-1) an isocyanate compound having as functional groups at least two isocyanate groups per molecule in (b-2) a thermoplastic resin that is substantially non-reactive with isocyanate. The isocyanate compound (b-1) may be any of diisocyanate compounds used in the prior art relating to thermoplastic polyurethanes. Examples include, but are not limited to, aromatic diisocyanates such as 4,4'-diphenylmethane diisocyanate, 2,4-toluene diisocyanate and 2,6-toluene diisocyanate, and aliphatic diisocyanates such as hexamethylene diisocyanate. Of these, 4,4'-diphenylmethane diisocyanate is most preferred for reactivity and handling safety.

The thermoplastic resin (b-2) is preferably a resin having a low water absorption and excellent compatibility with thermoplastic polyurethane materials. Illustrative, non-limiting, examples of such resins include polystyrene resins, polyvinyl chloride resins, ABS resins, polycarbonate resins, and polyester elastomers (e.g., polyether-ester block copolymers, polyester-ester block copolymers). From the resilience and strength standpoints, preference is given to polyester elastomers, especially polyether-ester block copolymers.

In the isocyanate mixture (B), it is preferred to mix the thermoplastic resin (b-2) with the isocyanate compound (b-1) in a weight ratio of from 100:5 to 100:100, and especially from 100:10 to 100:40. If the amount of isocyanate component (b-1) relative to thermoplastic resin (b-2) is too small, more isocyanate mixture (B) must be added to achieve sufficient addition for the crosslinking reaction with the thermoplastic polyurethane (A). In such cases, thermoplastic resin (b-2) exerts a larger effect, which may render inadequate the physical properties of the cover molding composition (C). If the amount of isocyanate compound (b-1) relative to thermoplastic resin (b-2) is too large, isocyanate compound (b-1) may cause slippage to occur during mixing, making it difficult to prepare the isocyanate mixture (B).

The isocyanate mixture (B) can be prepared by blending isocyanate compound (b-1) into thermoplastic resin (b-2) and thoroughly working together these components at a temperature of 130 to 250° C. using mixing rollers or a Banbury mixer, followed by pelletization or cooling and grinding. The isocyanate mixture (B) is commercially available, for example, as Crossnate EM30 (made by Dainichi Seika Colour & Chemicals Mfg. Co., Ltd.).

(C) Cover Molding Composition

The cover molding composition (C) contains the thermoplastic polyurethane material (A) and the isocyanate mixture (B) as main components. In the preferred cover molding composition, the thermoplastic polyurethane material (A) and the isocyanate mixture (B) are mixed in a weight ratio of from 100:1 to 100:100, more preferably from 100:5 to 100:50, even more preferably from 100:10 to 100:30. If the amount of isocyanate mixture (B) relative to thermoplastic polyurethane material (A) is too small, the crosslinking effect may become insufficient. If the amount of isocyanate mixture (B) is too large, unreacted isocyanate can cause undesirable coloration of the molded composition.

In addition to the above-mentioned components, the cover molding composition (C) may contain other components. Illustrative examples of such additional components include thermoplastic polymeric materials other than thermoplastic polyurethane, such as polyester elastomers, polyamide elastomers, ionomer resins, styrene block elastomers, polyethylene and nylon resins. The thermoplastic polymeric materials other than thermoplastic polyurethane are typically included in amounts of 0 to 100 parts by weight, preferably 1 to 75 parts by weight, and more preferably 10 to 50 parts by weight, per 100 parts by weight of the thermoplastic polyurethane material serving as the essential component. The type and amount of thermoplastic polymeric material are selected as appropriate for such purposes as adjusting the hardness of the cover composition and improving resilience, flow and adhesion. If necessary, the cover molding composition (C) may also include various additives such as pigments, dispersants, antioxidants, light stabilizers, ultraviolet absorbers, and parting agents.

The cover may be molded from the cover molding composition (C), for example, by adding isocyanate mixture (B) to thermoplastic polyurethane material (A) and dry mixing. Using an injection molding machine, the mixture is molded over the core to form a cover therearound. Molding is generally carried out at a temperature in the range of 150 to 250° C., although the molding temperature will depend on the type of thermoplastic polyurethane material (A).

Reactions and crosslinking which take place in the cover thus obtained are believed to involve the reaction of isocyanate groups with hydroxyl groups remaining on the thermoplastic polyurethane material to form urethane bonds, or the addition reaction of isocyanate groups to urethane groups on the thermoplastic polyurethane material to form an allophanate or biuret crosslinked form. Although the crosslinking reaction has not yet proceeded to a sufficient degree immediately subsequent to injection molding of the cover molding composition (C), the crosslinking reaction can be forwarded by carrying out an annealing step after molding, in this way conferring the golf ball with useful cover characteristics. "Annealing," as used herein, refers to heat aging the cover at a certain temperature for a predetermined length of time, or aging the cover for a predetermined period at room temperature.

The outermost layer cover has a gage of 0.5 to 1.8 mm, preferably 0.8 to 1.6 mm, more preferably 1.0 to 1.3 mm. If the outermost layer cover is too thin, the ball may become less controllable and less resistant to scuff. Inversely, if the outermost layer cover is too thick, the rebound may become too low to travel a distance.

The outermost layer cover should preferably have a Shore D hardness of 45 to 60, more preferably 50 to 56. Outside the range, too low a cover hardness may lead to poor rebound and too much spin on driver (W#1) shots, resulting in a reduction of carry. Too high a cover hardness may compromise scuff resistance and durability to repeated impact.

The intermediate layer used herein is a single layer or a plurality of layers disposed between the solid core and the outermost layer cover. At least one layer of the intermediate layer is formed of a resin composition having organic short fibers compounded therein.

The organic short fibers compounded in the intermediate layer are preferably made of a binary copolymer consisting of a polyolefin component and a polyamide component.

The polyolefin component which can be used includes low-density polyethylene (LDPE), high-density polyethylene (HDPE), polypropylene or polystyrene. Of these, polyethylene, especially low-density polyethylene having high crystallinity is preferred.

For the polyamide component, use may be made of nylon 6, nylon 66, nylon 11, nylon 12, nylon 610, nylon 612, copolymerized nylon, nylon MXD6, nylon 46, aramid, polyamide-imide, polyimide and the like. Nylon 6 is preferred from a balance of physical properties and cost. The polyamide component preferably takes the form of fibers, with nylon fibers being especially preferred. It is preferred that the nylon fibers have an average diameter of up to 10 μm, more preferably up to 5 μm, even more preferably up to 1 μm, but at least 0.01 μm because better reinforcement effects are developed for a certain amount blended. It is noted that the average diameter is a measurement from observation of a sample cross-section under a transmission electron microscope.

The preferred form of the binary copolymer is a crystalline polyolefin component bound to surfaces of nylon fibers. As used herein, the term"bound" means that the polyamide and polyolefin components are graft linked by adding a binder. The binders used herein include silane coupling agents, titanate coupling agents, unsaturated carboxylic acids, unsaturated carboxylic acid derivatives, organic peroxides and the like.

In the binary component, polyolefin component and polyamide component are preferably blended in a weight ratio between 25/75 and 95/5, more preferably between 30/70 and 90/10, and even more preferably between 40/60 and 75/25. Too little polyamide component fails to exert sufficient reinforcing effects. Too much polyamide component makes it difficult to mix with the base resin during kneading on a twin screw extruder or the like.

Also, the base resin and the binary copolymer (organic short fibers) are preferably blended in a weight ratio between 100/0.1 and 100/50, more preferably between 100/1 and 100/40, even more preferably between 100/2 and 100/30. Too less a blending amount fails to exert sufficient effects. Too much a blending amount interferes with kneading or molding into a golf ball cover.

The temperature at which the base resin and the binary copolymer are kneaded is preferably equal to or higher than the melting point of polyolefin component, more preferably at least 10° C. higher than the melting point of polyolefin component, and equal to or lower than the melting point of the polyamide component, more preferably at least 10° C. lower than the melting point of polyamide component, in order to maintain the shape of polyamide component as intact as possible. However, the kneading temperature is not necessarily limited to this range.

The temperature of the resin when molded into a golf ball is also preferably in the above-defined temperature range, but may be higher if necessary.

In the resin composition comprising the base resin and the binary copolymer as essential components, various additives may be blended in addition to the resin components, if necessary. Such additives include, for example, pigments, dispersants, antioxidants, UV absorbers, UV stabilizers, parting agents, plasticizers, and inorganic fillers (zinc oxide, barium sulfate, titanium dioxide, etc.). It is preferred that the base resin and the binary copolymer be included in a total amount of at least 30% by weight, especially 60 to 100% by weight in the resin composition in order to achieve the desired effects of the invention.

The base resin in the intermediate layer essentially contains a base resin comprising, in admixture, (a) an olefin-unsaturated carboxylic acid binary random copolymer and/or a metal ion-neutralized product of an olefin-unsaturated carboxylic acid binary random copolymer and (b) an olefin-unsaturated carboxylic acid-unsaturated carboxylic acid ester ternary random copolymer and/or a metal ion-neutralized product of an olefin-unsaturated carboxylic acid-unsaturated carboxylic acid ester ternary random copolymer in specific amounts.

The olefins in the base resin, whether they are in component (a) or (b), are preferably those having at least 2 carbon atoms, but not more than 8, and especially not more than 6 carbon atoms. Specific examples include ethylene, propylene, butene, pentene, hexene, heptene and octene. Ethylene is especially preferred.

The unsaturated carboxylic acid is exemplified by acrylic acid, methacrylic acid, maleic acid and fumaric acid. Acrylic acid and methacrylic acid are especially preferred.

The unsaturated carboxylic acid esters are preferably lower alkyl esters of the foregoing unsaturated carboxylic acids. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) are especially preferred.

The olefin-unsaturated carboxylic acid binary random copolymers serving as component (a) and olefin-unsaturated carboxylic acid-unsaturated carboxylic acid ester ternary random copolymers serving as component (b) (the copolymers in components (a) and (b) are collectively referred to as "random copolymers," hereinafter) can be obtained by adjusting the above-described materials and effecting random copolymerization by a well-known method.

It is recommended that the random copolymer have a controlled content of unsaturated carboxylic acid (acid content). It is recommended that the unsaturated carboxylic acid content within the random copolymer serving as component (a) be typically at least 4 wt %, preferably at least 6 wt %, more preferably at least 8 wt %, and most preferably at least 10 wt %, and as the upper limit, typically not more than 30 wt %, preferably not more than 20 wt %, more preferably not more than 18 wt %, and most preferably not more than 15 wt %.

Similarly, it is recommended that the unsaturated carboxylic acid content within the random copolymer serving as component (b) be typically at least 4 wt %, preferably at least 6 wt %, more preferably at least 8 wt %, and as the upper limit, typically not more than 15 wt %, preferably not more than 12 wt %, more preferably not more than 10 wt %. A random copolymer with too low an acid content may be less resilient whereas too high an acid content may detract from processability.

The metal ion-neutralized products of olefin-unsaturated carboxylic acid binary random copolymers serving as component (a) and metal ion-neutralized products of olefin-unsaturated carboxylic acid-unsaturated carboxylic acid ester ternary random copolymers serving as component (b) (the metal ion-neutralized products of copolymers in components (a) and (b) are collectively referred to as "metal ion-neutralized products of random copolymers," hereinafter) can be obtained by partially neutralizing acid groups on the random copolymer with metal ions.

Illustrative examples of metal ions for neutralizing the acid groups include $Na^+$, $K^+$, $Li^+$, $Zn^{2+}$, $Cu^{2+}$, $Mg^{2+}$, $Ca^{2+}$, $Co^{2+}$, $Ni^{2+}$and $Pb^{2+}$. Preferred metal ions include $Na^+$, $Li^+$, $Zn^{2+}$, and $Mg^{2+}$, with $Zn^{2+}$ being especially preferred.

In producing the metal ion-neutralized products of random copolymers, the random copolymers may be neutralized with the metal ions. For example, a neutralizing method using suitable compounds of the metal ions, such as formates, acetates, nitrates, carbonates, hydrogencarbonates, oxides, hydroxides and alkoxides may be employed. The degree of neutralization of the random copolymer with the metal ions is not particularly limited.

Of the metal ion-neutralized products of random copolymers used herein, zinc ion-neutralized ionomer resins are preferred because they are effective for increasing the melt flow rate of the material for adjusting to an optimum melt flow rate to be described later, and improving moldability.

Commercial products may be used as components (a) and (b) of the base resin. Specifically, commercial products of the random copolymer as component (a) include Nucrel 1560, 1214 and 1035 (all products of DuPont-Mitsui Polychemicals Co., Ltd.) and ESCOR 5200, 5100 and 5000 (all products of EXXONMOBIL CHEMICAL); and commercial products of the random copolymer as component (b) include Nucrel AN4311 and AN4318 (all products of DuPont-Mitsui Polychemicals Co., Ltd.) and ESCOR ATX325, ATX320 and ATX310 (all products of EXXONMOBIL CHEMICAL).

Additionally, commercial products of the metal ion-neutralized product of random copolymer as component (a) include Himilan 1554, 1557, 1601, 1605, 1706 and AM7311 (all products of DuPont-Mitsui Polychemicals Co., Ltd.), Surlyn 7930 (E.I. DuPont de Nemours and Company), and Iotek 3110 and 4200 (EXXONMOBIL CHEMICAL); and commercial products of the metal ion-neutralized product of random copolymer as component (b) include Himilan 1855, 1856 and AM7316 (all products of DuPont-Mitsui Polychemicals Co., Ltd.), Surlyn 6320, 8320, 9320 and 8120 (all products of E.I. DuPont de Nemours and Company), and Iotek 7510 and 7520 (all products of EXXONMOBIL CHEMICAL). Examples of the zinc neutralized ionomer resins which are preferred among the metal ion-neutralized products of random copolymers include Himilan 1706, 1557 and AM7316.

In the preparation of the base resin, components (a) and (b) should be compounded in a weight ratio between 100:0 and 25:75, preferably between 100:0 and 50:50, more preferably between 100:0 and 75:25, even more preferably 100:0. With too less an amount of component (a), the molded material has reduced resilience.

Also, the base resin is improved in moldability by the above-described preparation and additionally, by adjusting the compounding ratio of the random copolymer and the metal ion-neutralized product of random copolymer. It is recommended that the random copolymer and the metal ion-neutralized product of random copolymer be compounded in a ratio typically between 0:100 and 60:40, preferably between 0:100 and 40:60, more preferably between 0:100 and 20:80, even more preferably 0:100. Too much an amount of the random copolymer compounded may have negative impact on the moldability during mixing.

Component (e) is a non-ionomeric thermoplastic elastomer which is included to further enhance both the feel of the golf ball upon impact and its rebound characteristics. Specific examples of non-ionomeric thermoplastic elastomers include olefin elastomers, styrene elastomers, polyester elastomers, urethane elastomers and polyamide elastomers. The use of polyester elastomers and olefin elastomers, especially olefin elastomers in the form of thermoplastic block copolymers containing crystalline polyethylene blocks as hard segments is preferred for further increased resilience.

Examples of commercial products that may be used as component (e) include Dynaron (by JSR Corporation) and polyester elastomers such as Hytrel (by DuPont-Toray Co., Ltd.).

It is recommended that the amount of component (e) per 100 parts by weight of the base resin in the material be typically 0 part or more, preferably at least 1 part, more preferably at least 2 parts, even more preferably at least 3 parts, and most preferably at least 4 parts by weight, and as the upper limit, not more than 100 parts, preferably not more than 60 parts, more preferably not more than 40 parts, and most preferably not more than 20 parts by weight. Too much component (e) may lower the compatibility of the mixture and markedly compromise the durability of the golf ball.

Next, component (c) is a fatty acid or fatty acid derivative having a molecular weight of 280 to 1,500. This lo component has a very low molecular weight compared with the base resin and is used to adjust the melt viscosity of the mixture to a suitable level, particularly to help improve flow. Component (c) has a relatively high content of acid groups (or derivatives thereof) and can prevent an excessive loss of resilience.

The molecular weight of the fatty acid or fatty acid derivative of component (c) is at least 280, preferably at least 300, more preferably at least 330, and most preferably at least 360, but not more than 1,500, preferably not more than 1,000, more preferably not more than 600, and most preferably not more than 500. Too low a molecular weight may prevent a better heat resistance from being achieved, whereas too high a molecular weight may make it impossible to improve flow.

Preferred examples of the fatty acid or fatty acid derivative serving as component (c) include unsaturated fatty acids having a double bond or triple bond on the alkyl group as well as derivatives thereof, and saturated fatty acids in which all the bonds on the alkyl group are single bonds as well as derivatives thereof. It is recommended that the number of carbons on the molecule be typically at least 18, preferably at least 20, more preferably at least 22, and most preferably at least 24, but not more than 80, preferably not more than 60, more preferably not more than 40, and most preferably not more than 30. Too few carbons may prevent a better heat resistance from being achieved and may also make the content of acid groups so high as to diminish the flow-enhancing effect on account of interactions between acid groups in component (c) and acid groups present in the base resin. On the other hand, too many carbons increases the molecular weight, which may also prevent the desired flow-enhancing effect from being achieved.

Specific examples of fatty acids that may be used as component (c) include stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred. Behenic acid is especially preferred.

Fatty acid derivatives which may be used as component (c) include metallic soaps in which the proton on the acid group of the fatty acid has been substituted with a metal ion. Metal ions that may be used in such metallic soaps include $Na^+$, $Li^+$, $Ca^{2+}$, $Mg^{2+}$, $Zn^{2+}$, $Mn^{2+}$, $Al^{3+}$, $Ni^{2+}$, $Fe^{2+}$, $Fe^{3+}$, $Cu^{2+}$, $Sn^{2+}$, $Pb^{2+}$ and $Co^{2+}$. Of these, $Ca^{2+}$, $Mg^{2+}$ and $Zn^{2+}$ are preferred.

Specific examples of fatty acid derivatives that may be used as component (c) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

Component (d) is a basic inorganic metal compound which can neutralize acid groups in the base resin and component (c). It is essential in the invention. When a metallic soap-modified ionomer resin (e.g., the metallic soap-modified ionomer resins mentioned in the above-cited patent publications) is used alone without including component (d), the metallic soap and the un-neutralized acid groups present on the ionomer resin undergo exchange reactions during mixture under heating, generating a large amount of fatty acid. Because the fatty acid has a low thermal stability and readily vaporizes during molding, it may cause molding defects. Moreover, it adheres to the surface of the molded article, which can substantially lower paint film adhesion.

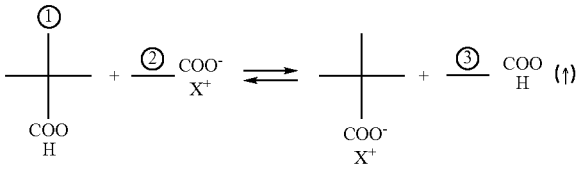

(1)

(1) un-neutralized acid group present on the ionomer resin
(2) metallic soap
(3) fatty acid
$X^+$: metal cation To solve these problems, a basic inorganic metal compound which neutralizes acid groups present in the base resin and in component (c) is included as essential component (d), for thereby improving the resilience of the molded product.

That is, incorporating essential component (d) in the material results in a suitable degree of neutralization of the acid groups in the base resin and in component (c). Moreover, optimizing the various components in this way produces synergistic effects which increase the thermal stability of the mixture, impart a good processability and make it possible to enhance the resilience.

It is recommended that the basic inorganic metal compound used as component (d) be one which has a high reactivity with the base resin and includes no organic acids in the reaction by-products, thus enabling the degree of neutralization of the mixture to be increased without a loss of thermal stability.

Illustrative examples of the metal ions in the basic inorganic metal compound serving as component (d) include $Li^+$, $Na^+$, $K^+$, $Ca^{2+}$, $Mg^{2+}$, $Zn^{2+}$, $Al^{3+}$, $Ni^{2+}$, $Fe^{2+}$, $Fe^{3+}$, $Cu^{2+}$, $Mn^{2+}$, $Sn^{2+}$, $Pb^{2+}$ $Co^{2+}$. Known basic inorganic fillers containing these metal ions may be used as the basic inorganic metal compound. Specific examples include magnesium oxide, magnesium hydroxide, magnesium carbonate, zinc oxide, sodium hydroxide, sodium carbonate, calcium oxide, calcium hydroxide, lithium hydroxide and lithium carbonate. A hydroxide or monoxide is recommended. Calcium hydroxide and magnesium oxide, both of which have a high reactivity with the base resin, are preferred. Calcium hydroxide is especially preferred.

Because the above-described material is arrived at by blending specific respective amounts of components (c) and (d) with the resin component, i.e., the base resin containing specific respective amounts of components (a) and (b) in combination with optional component (e), this material has excellent thermal stability, flow properties and moldability, and can impart the molded product with a markedly improved resilience.

Components (c) and (d) are compounded in respective amounts, per 100 parts by weight of the resin component suitably formulated from components (a), (b) and (e), of at least 5 parts by weight, preferably at least 10 parts by weight, more preferably at least 15 parts by weight, and most preferably at least 18 parts by weight, but not more than 80 parts by weight, preferably not more than 40 parts by weight, more preferably not more than 25 parts by weight, and most preferably not more than 22 parts by weight, of component (c); and at least 0.1 part by weight, preferably at least 0.5 part by weight, more preferably at least 1 part by weight, and most preferably at least 2 parts by weight, but not more than 10 parts by weight, preferably not more than 8 parts by weight, more preferably not more than 6 parts by weight, and most preferably not more than 5 parts by weight, of component (d). Too little component (c) lowers the melt viscosity, resulting in inferior processability, whereas too much lowers the durability. Too little component (d) fails to improve thermal stability and resilience, whereas too much instead lowers the heat resistance of the golf ball-forming material due to the presence of excess basic inorganic metal compound.

In the above-described material which is preferably formulated from the respective above-indicated amounts of the foregoing resin component and components (c) and (d), it is recommended that at least 50 mol %, preferably at least 60 mol %, more preferably at least 70 mol %, and most preferably at least 80 mol %, of the acid groups be neutralized. Such a high degree of neutralization makes it possible to more reliably suppress the exchange reactions that cause trouble when only a base resin and a fatty acid or fatty acid derivative are used as in the above-cited prior art, thus preventing the formation of fatty acid. As a result, there is obtained a material of greatly increased thermal stability and good processability which can provide a molded product with much better resilience than prior-art ionomer resins.

"Degree of neutralization," as used above, refers to the degree of neutralization of acid groups present within the mixture of the base resin and the fatty acid or fatty acid derivative serving as component (c), and differs from the degree of neutralization of the ionomer resin itself when an ionomer resin is used as the metal ion-neutralized random copolymer in the base resin. A mixture according to the invention having a certain degree of neutralization, when compared with an ionomer resin alone having the same degree of neutralization, contains a very large number of metal ions. This large number of metal ions increases the density of ionic crosslinks which contribute to improved resilience, making it possible to confer the molded product with excellent resilience.

To more reliably achieve a material having both a high degree of neutralization and good flow properties, it is recommended that the acid groups in the above-described mixture be neutralized with transition metal ions and with alkali metal and/or alkaline earth metal ions. Although transition metal ions have a weaker ionic cohesion than alkali metal and alkaline earth metal ions, the combined use of these different types of ions to neutralize acid groups in the mixture can provide a substantial improvement in the flow properties.

It is recommended that the molar ratio between the transition metal ions and the alkali metal and/or alkaline earth metal ions be within a range of typically 10:90 to 90:10, preferably 20:80 to 80:20, more preferably 30:70 to 70:30, and most preferably 40:60 to 60:40. Too low a molar ratio of transition metal ions may fail to provide sufficient improvement in the flow properties of the material. On the other hand, a transition metal ion molar ratio that is too high may lower the resilience.

Specific, non-limiting, examples of the metal ions include zinc ions as the transition metal ions and at least one type of ion selected from among sodium, lithium and magnesium ions as the alkali metal or alkaline earth metal ions.

A known method may be used to obtain a mixture in which the desired amount of acid groups have been neutralized with transition metal ions and alkali metal or alkaline earth metal ions. Specific examples of methods of neutralization with transition metal ions, particularly zinc ions, include the use of zinc soaps as the fatty acid derivative, the use of zinc ion-neutralized products (e.g., zinc ion-neutralized ionomer resins) when formulating components (a) and (b) as the base resin, and the use of zinc compounds such as zinc oxide as the basic inorganic metal compound of component (d).

The resin material should preferably have a melt flow rate adjusted to ensure flow properties that are particularly suitable for injection molding and thus improve moldability. Specifically, it is recommended that the melt flow rate (MFR), as measured according to JIS-K7210 at a temperature of 190° C. and under a load of 21.18 N (2.16 kgf), be set to typically at least 0.5 dg/min, preferably at least 1 dg/min, more preferably at least 1.5 dg/min, and even more preferably at least 2 dg/min, but typically not more than 20 dg/min, preferably not more than 10 dg/min, more preferably not more than 5 dg/min, and most preferably not more than 3 dg/min. Too large or small a melt flow rate may result in a marked decline in processability.

It is recommended that the resin material be formulated so as to provide a Shore D hardness of typically at least 50, preferably at least 53, more preferably at least 56, and most preferably at least 58, but typically not more than 75, preferably not more than 70, more preferably not more than 65, and most preferably not more than 62. If the Shore D hardness is too high, the resulting golf ball may have a markedly diminished feel upon impact. Too low a hardness may reduce the rebound of the ball.

The intermediate layer has a gage of 0.5 to 2.0 mm, preferably 1.0 to 1.8 mm, more preferably 1.3 to 1.7 mm. If the intermediate layer is too thin, the durability to repeated impact may become poor. If the intermediate layer is too thick, the ball may receive more spin when hit with a driver (W#1), travel a less carry, and give too hard a feel.

A sphere in the form of the core enclosed with the intermediate layer has a surface hardness of 56 to 75, preferably 61 to 68, more preferably 63 to 66, in Shore D hardness. Too high a surface hardness may detract from the durability to repeated impact whereas too low a surface hardness may allow the ball to gain too much spin and follow a skying trajectory, failing to travel a distance. As used herein, "Shore D hardness" refers to a measurement by a type D durometer according to ASTM D-2240.

The total gage of the intermediate layer and the outermost layer cover, that is, the overall gage of the cover is typically in the range of 1.5 to 3.0 mm, preferably 2.0 to 2.9 mm and more preferably 2.4 to 2.8 mm. If the overall gage of the cover is too small, the durability to repeated impact may be degraded. If the overall gage of the cover is too large, the ball may receive more spin when hit with a driver (W#1), failing to travel a carry.

If desired, an adhesive layer may intervene between the intermediate layer and the cover for the purpose of improving durability to impact. However, the provision of such an adhesive layer is unnecessary when the intermediate layer and the cover are formed of materials which tightly bond with each other. When the adhesive layer is provided, the adhesive used is not critical. Epoxy resin adhesives, vinyl resin adhesives and rubber adhesives are useful, although urethane resin adhesives and chlorinated polyolefin adhesives are preferred. Commercial products are available, and a urethane resin adhesive Resamine D6208 (by Dainichiseika Color & Chemicals Mfg. Co., Ltd.) and a chlorinated polyolefin adhesive RB182 Primer (by Nippon Bee Chemical Co., Ltd.) are useful. Preferably the adhesive layer has a gage of at least 0.1 μm, especially at least 0.2 μm and up to 30 μm, especially up to 25 μm.

Dispersion coating may be used to form the adhesive layer. The type of emulsion which is used in dispersion coating is not critical. The resin powder used in preparing the emulsion may be either thermoplastic resin powder or thermosetting resin powder. Exemplary resins are vinyl acetate resins, vinyl acetate copolymer resins, EVA (ethylene-vinyl acetate copolymer resins), acrylate (co)polymer resins, epoxy resins, thermosetting urethane resins, and thermoplastic urethane resins. Of these, epoxy resins, thermosetting urethane resins, thermoplastic urethane resins, and acrylate (co)polymer resins are preferred, with the thermoplastic urethane resins being most appropriate.

With respect to the surface hardness of the golf ball of the invention, it has a Shore D hardness of 52 to 64, preferably 54 to 62, more preferably 56 to 60. With too low a hardness, the ball may receive too much spin when hit with a driver (W#1) and draw a too skying trajectory to travel a distance. With too high a hardness, the ball may receive little spin on approach shots and iron shots and become less controllable.

The golf ball of the invention for competition play should comply with the Rules of Golf. The ball is formed to such an outer diameter of not more than 42.80 mm that the ball does not pass through a ring having an inner diameter of 42.672 mm and typically a weight of 45.0 to 45.93 g.

EXAMPLE

Examples of the invention and comparative examples are given below by way of illustration and not by way of limitation.

Examples and Comparative Examples

Solid cores in Examples and Comparative Examples were prepared in accordance with the core formulation and vulcanization procedure shown in Table 1.

TABLE 1

| | | Example 1 | Example 2 | Comparative Example 1 | Comparative Example 2 |
|---|---|---|---|---|---|
| Core formulation (pbw) | Polybutadiene A | 50 | 50 | 50 | 50 |
| | Polybutadiene B | 50 | 50 | 50 | 50 |
| | Zinc acrylate | 29.5 | 29.5 | 29.5 | 29.5 |
| | Organic peroxide (1) | 0.3 | 0.3 | 0.3 | 0.3 |
| | Organic peroxide (2) | 0.3 | 0.3 | 0.3 | 0.3 |
| | Antioxidant | 0.1 | 0.1 | 0.1 | 0.1 |
| | Zinc oxide | 23.4 | 23.4 | 23.4 | 23.4 |
| | Zinc stearate | 5 | 5 | 5 | 5 |
| | Zinc salt of pentachlorothiophenol | 0.2 | 0.2 | 0.2 | 0.2 |
| | Vulcanization (temp./time) | 158° C./15 min | 158° C./15 min | 158° C./15 min | 158° C./15 min |

Note:
Polybutadiene A: BR01 (Ni catalyst), by JSR Corp.
Polybutadiene B: BR730 (Nd catalyst), by JSR Corp.
Organic peroxide (1): dicumyl peroxide, Percumil D (trade name), by NOF Corp.
Organic peroxide (2): 1,1-bis(t-butylperoxy)-3,3,5-trimethylcyclohexane, Perhexa 3M-40 (trade name), by NOF Corp.
Antioxidant: Nocrac NS-6 (trade name), Ouchi Shinko Chemical Industry Co., Ltd.

Next, each of the solid cores in Examples and Comparative Examples was enclosed with an intermediate layer and an outermost layer cover made of cover resin compositions of formulations A to E shown in Table 2, completing a three-piece solid golf ball. These balls were determined for flight performance and durability to repeated impact by the following tests. The results are shown in Table 3.

TABLE 2

| Components (pbw) | A | B | C | D | E |
|---|---|---|---|---|---|
| Himilan 1605 | 85 | 85 | 85 | — | — |
| Dynaron 6100P | 15 | 15 | 15 | — | — |
| Pandex T8295 | — | — | — | 50 | 50 |
| Pandex T8260 | — | — | — | 50 | 50 |
| Polyethylene wax | — | — | — | 1.5 | 1.5 |
| Isocyanate compound | — | — | — | 10 | 10 |
| Behenic acid | 20 | 20 | 20 | — | — |
| Calcium hydroxide | 2.9 | 2.9 | 2.9 | — | — |
| Titanium dioxide | — | — | — | 4 | 4 |
| Polyolefin/polyamide binary copolymer 1 | 5 | — | — | — | 5 |
| Polyolefin/polyamide binary copolymer 2 | — | 5 | — | — | — |

Note that the trade names and materials described in Table 2 have the following meaning.

Himilan 1605: ionomer resin, by Dupont-Mitsui Polychemicals Co., Ltd.

Dynaron 6100P: olefin thermoplastic elastomer, by JSR Corp.

Pandex T8295: thermoplastic polyurethane elastomer by DIC Bayer Polymer Ltd.

Pandex T8260: thermoplastic polyurethane elastomer by DIC Bayer Polymer Ltd.

Behenic acid: NAA222-S beads, by NOF Corp.

Calcium hydroxide: CLS-B, by Shiraishi Kogyo Co., Ltd.

Polyolefin/polyamide binary copolymer 1: LA0010, by Daiwa Polymer Co., Ltd., polyolefin (low density polyethylene)/polyamide (nylon 6) short fibers ratio=50/50 in weight ratio Polyolefin/polyamide binary copolymer 2: polyolefin (low density polyethylene)/polyamide (nylon 6) short fibers ratio=80/20 in weight ratio Isocyanate compound: trade name Crossnate EM30, made by Dainichiseika Color & Chemicals Mfg. Co., Ltd. An isocyanate master batch contains 30 wt % 4,4'-diphenylmethane diisocyanate (isocyanate concentration as determined by amine back titration according to JIS K1556: 5–10%). The master batch base resin is a polyester elastomer. On use, the isocyanate compound was milled with the remaining cover components at the same time as injection molding.

Flight Performance

By using a hitting robot equipped with a club and hitting each ball at a head speed of 45 m/s, a total distance was measured. The total distance was computed as an average of ten balls. The club used was a driver (W#1) Tour Stage X-Drive Type 325 (loft angle 90°).

○: total distance ≧215 m

X: total distance <215 m

Durability to Repeated Impact

Each ball was repeatedly struck at a head speed of 45 m/s. The club used was the same as used in the flight performance test. The number of strikes when the ball started cracking was counted. A relative index was computed based on a value of 100 for the number of strikes to the ball of Example 1. The initial velocity of the ball when actually struck was monitored. The number of strikes repeated until the initial velocity declined by 3% or more from the actual initial velocity on average of initial ten strikes was the number of strikes when the ball started cracking.

◎: index ≧98

○: index ≧95

X: index <90

TABLE 3

| | | Example | | Comparative Example | |
|---|---|---|---|---|---|
| | | 1 | 2 | 1 | 2 |
| Solid core | Outer diameter (mm) | 37.3 | 37.3 | 37.3 | 37.3 |
| | Weight (g) | 32.0 | 32.0 | 32.0 | 32.0 |
| | Surface hardness (Shore D) | 56 | 56 | 56 | 56 |
| | Center hardness (Shore D) | 40 | 40 | 40 | 40 |
| | Hardness difference between surface and center | 16 | 16 | 16 | 16 |
| Sphere | Intermediate layer material | A | B | C | C |
| | Intermediate layer gage (mm) | 1.6 | 1.6 | 1.6 | 1.6 |
| | Surface hardness (Shore D) | 65 | 65 | 65 | 65 |
| | Outer diameter (mm) | 40.5 | 40.5 | 40.5 | 40.5 |
| | Adhesive layer between intermediate layer and cover | Yes | Yes | Yes | Yes |
| Ball as a whole | Outermost layer cover material | D | D | D | E |
| | Outermost layer cover gage (mm) | 1.2 | 1.2 | 1.2 | 1.2 |
| | Surface hardness (Shore D) | 58 | 58 | 58 | 58 |
| | Outer diameter (mm) | 42.7 | 42.7 | 42.7 | 42.7 |
| | Weight (g) | 45.5 | 45.5 | 45.5 | 45.5 |
| | Surface hardness of ball − Surface hardness of sphere | −7 | −7 | −7 | −7 |
| Flight performance (W#1, HS = 45) | Total (m) | 218.5 | 218.3 | 219.3 | 218.3 |
| | Rating | ○ | ○ | ○ | ○ |
| | Durability to repeated impact | 100 ◎ | 95 ○ | 89 X | 90 X |

Note that the sphere results from enclosing the core with the intermediate layer.

The surface hardness of the core is measured according to ASTM D-2240.

The center hardness of the core is measured by cutting the core into hemispheres and measuring the hardness at the center according to ASTM D-2240.

The surface hardness of the sphere is measured according to ASTM D-2240.

The adhesive layer between the intermediate layer and the cover is RB182 Primer by Nippon Bee Chemical Co., Ltd. and has a thickness of 2.0 μm.

As is evident from the results of Table 3, the golf balls of Examples travel a satisfactory flight distance when hit in a high head speed region including a head speed of 45 m/s and are improved in durability to repeated impact.

In contrast, the golf ball of Comparative Example 1, in which no organic short fibers are compounded in the intermediate layer, was poor in durability to repeated impact. The golf ball of Comparative Example 2, in which organic short fibers are compounded only in the outermost layer cover, was poor in durability to repeated impact like Comparative Example 1.

The invention claimed is:

1. A multi-piece solid golf ball comprising a core, an outermost layer cover, and an intermediate layer of one or more layers disposed therebetween, wherein:

at least one layer of the intermediate layer is formed of a resin composition having organic short fibers compounded therein;

the organic short fibers have an average diameter of up to 10 μm;

a sphere in the form of the core enclosed with the intermediate layer has a surface hardness of 56 to 75 in Shore D hardness;

the ball as a whole has a surface hardness of 52 to 64 in Shore D hardness;

the surface hardness of the ball as a whole is lower than the surface hardness of said sphere; and the total gage of said intermediate layer and said outermost layer cover is in the range of 1.5 to 3.0 mm.

2. The multi-piece solid golf ball of claim 1, wherein the resin composition of which the intermediate layer is formed includes a resin component comprising, in admixture, a base resin comprising, in admixture, (a) an olefin-unsaturated carboxylic acid binary random copolymer and/or a metal ion-neutralized product of an olefin-unsaturated carboxylic acid binary random copolymer and (b) an olefin-unsaturated carboxylic acid-unsaturated carboxylic acid ester ternary random copolymer and/or a metal ion-neutralized product of an olefin-unsaturated carboxylic acid-unsaturated carboxylic acid ester ternary random copolymer in a weight ratio between 100:0 and 25:75, and (e) a non-ionomeric thermoplastic elastomer in a weight ratio between 100:0 and 50:50.

3. The multi-piece solid golf ball of claim 1, wherein the resin composition of which the intermediate layer is formed is a mixture comprising, in admixture, 100 parts by weight of a resin component comprising, in admixture, a base resin comprising, in admixture, (a) an olefin-unsaturated carboxylic acid binary random copolymer and/or a metal ion-neutralized product of an olefin-unsaturated carboxylic acid binary random copolymer and (b) an olefin-unsaturated carboxylic acid-unsaturated carboxylic acid ester ternary random copolymer and/or a metal ion-neutralized product of an olefin-unsaturated carboxylic acid-unsaturated carboxylic acid ester ternary random copolymer in a weight ratio between 100:0 and 25:75, and (e) a non-ionomeric thermoplastic elastomer in the form of a thermoplastic block copolymer containing crystalline polyethylene blocks as hard segments in a weight ratio between 100:0 and 50:50, (c) 5 to 80 parts by weight of a fatty acid having a molecular weight of 280 to 1,500 and/or derivative thereof, and (d) 0.1 to 10 parts by weight of a basic inorganic metal compound capable of neutralizing un-neutralized acid groups in said base resin and component (c).

4. The multi-piece solid golf ball of claim 1, wherein the outermost layer cover is formed primarily of a polyurethane resin.

5. The multi-piece solid golf ball of claim 1, wherein the outermost layer cover is formed of a material based on a heated mixture of (A) a thermoplastic polyurethane material and (B) an isocyanate mixture of (b-1) an isocyanate compound having at least two isocyanate groups as functional groups in a molecule, dispersed in (b-2) a thermoplastic resin which is substantially non-reactive with isocyanate.

6. The multi-piece solid golf ball of claim 1, wherein the organic short fibers have an average diameter of up to 5 μm.

7. The multi-piece solid golf ball of claim 1, wherein the organic short fibers have an average diameter of up to 1 μm.

8. The multi-piece solid golf ball of claim 1, wherein the organic short fibers have an average diameter of at least 0.01 μm and up to 10 μm.

9. A multi-piece solid golf ball comprising a core, an outermost layer cover, and an intermediate layer of one or more layers disposed therebetween, wherein at least one layer of the intermediate layer is formed of a resin composition having organic short fibers compounded therein, and wherein the organic short fibers compounded in said intermediate layer are made of a binary copolymer consisting of a polyolefin component and a polyamide component.

10. The multi-piece solid golf ball of claim 9, wherein the organic short fibers have an average diameter of up to 10 μm.

11. The multi-piece solid golf ball of claim 9, wherein the organic short fibers have an average diameter of at least 0.01 μm.

12. The multi-piece solid golf ball of claim 9, wherein the organic short fibers have an average diameter of up to 5 μm.

13. The multi-piece solid golf ball of claim 9, wherein the organic short fibers have an average diameter of up to 1 μm.

14. The multi-piece solid golf ball of claim 9, wherein the polyolefin component and the polyamide component are blended in a weight ratio between 25/75 and 95/5.

15. The multi-piece solid golf ball of claim 9, wherein a base resin of the resin composition and the binary copolymer are blended in a weight ratio between 100/0.1 and 100/50.

* * * * *